United States Patent [19]

Grace

[11] Patent Number: 4,501,260

[45] Date of Patent: Feb. 26, 1985

[54] COOKTOP VENTILATION SYSTEM

[75] Inventor: William R. Grace, Alhambra, Calif.

[73] Assignee: Norris Industries Inc., Los Angeles, Calif.

[21] Appl. No.: 58,322

[22] Filed: Jul. 17, 1979

[51] Int. Cl.[3] ..... F24C 15/20

[52] U.S. Cl. ..... 126/299 R; 126/21 R; 126/300

[58] Field of Search ..... 126/299 R, 299 D, 301, 126/300, 302, 303, 214 A, 21 R; 98/41 R, 36; 49/131-134, 49

[56] References Cited

U.S. PATENT DOCUMENTS

| | | | |
|---|---|---|---|
| 1,999,492 | 4/1935 | Weiskopf | 126/285 A |
| 2,081,640 | 5/1937 | Petersen | 126/299 R |
| 2,674,991 | 4/1954 | Schaefer | 126/299 R |
| 3,011,492 | 12/1961 | Humbert | 126/299 R |
| 3,102,533 | 9/1963 | Jenn et al. | 126/303 |
| 3,409,005 | 11/1968 | Field | 126/299 R |
| 3,500,815 | 3/1970 | Weese et al. | 126/200 |
| 3,537,442 | 11/1970 | Berger | 126/299 R |
| 3,712,819 | 1/1973 | Field | 126/299 R |

*Primary Examiner*—James C. Yeung
*Attorney, Agent, or Firm*—Edward A. Sokolski

[57] ABSTRACT

An elongated relatively narrow vent member is mounted along the rear edge of a cooktop having a plurality of burners. The vent member has an air chamber formed therein which is coupled to a vent duct having a blower at the outlet thereof which provides suction in the chamber. A motor-driven drive system is provided to raise and lower an intake or "snorkel" member which is slidably mounted in the air chamber. The drive system operates in response to the actuation of a momentarily actuated pushbutton switch. The snorkel member has an intake slot formed along the top edge thereof such that when it is in its raised position, the intake slot is a substantial distance above the cooktop burners. In its lowered position, the snorkel member is fully recessed in the chamber and closes the vent system against backdrafts from the outside.

5 Claims, 7 Drawing Figures

COOKTOP VENTILATION SYSTEM

This invention relates to ventilation systems for cooktops, and more particularly to such a system which employs an elongated, motor-driven vent member which is mounted along the rear edge of the cooktop and a "snorkel" or intake element which is driven above the level of the cooktop when in use and retracted within the lower fixedly mounted vent portions when not in use.

Ventilation systems for cooktops for counter-type ranges often employ an exhaust ventilator which is located near the center of the range at the level of the heating elements. This type of exhaust vent is shown in U.S. Pat. Nos. 3,367,320 and 3,797,375. This approach to ventilation has the disadvantage of drawing cool air across the food being cooked which lowers the efficiency of the cooking action and cools the food rapidly after the heaters are turned off. Of course, this problem can be avoided by employing the typical hood structure which is mounted above the cooktop, but this involves a rather bulky and somewhat unattractive installation.

A technique for venting at a level above the cooktop which employs a device integrated within the cooktop is described in U.S. Pat. No. 3,102,533. This device involves a vent which is incorporated in a countertop for the cooktop. The device described in this patent, while it provides a venting at a level substantially above that of the cooktop, has several shortcomings. First, it involves a rather bulky countertop structure which may not be desired by the customer. Further, the incorporation of the venting duct in a hinged cover presents a problem in design insofar as air tightness of the duct along the hinge. Leaks along the hinge, of course, could result in there being air flow at the level of the cooktop with the aforementioned undesirable results. Also, it is somewhat inconvenient for the user to have to lift the countertopvent up manually every time the cooktop is to be used and to lower it back into position after such use. While in this prior art device the vent can be left in the raised position at all times, this leaves much to be desired cosmetically and would not be feasible if the cooktop were to be installed in a "peninsula" or pass-through type arrangement, i.e., in the center of the kitchen, away from the walls. Further, in the device of the aforementioned patent, the blower is installed close to the intake and thus operates to blow the air out the exhaust. This has shortcomings as compared with a vacuum-type system with the blower placed at the exhaust end of the ducting so as to draw a vacuum in the venting duct.

The device of the present invention overcomes the shortcomings of the prior art by providing an elongated vent member which runs along the rear edge of the cooktop behind the heating units. The vent member includes a fixed lower portion forming an air chamber and an intake element or "snorkel" which is slidably mounted in the chamber formed at this location on a suitable support mechanism. The "snorkel" of the present invention has a venting inlet along its top edge, this edge being positioned a substantial distance above the level of the heating units in the raised position. A drive mechanism is provided for driving the snorkel upwards out of the air chamber to a venting position and downward into the chamber to a retracted position with its top edge approximately at or below the cooktop level. The drive mechanism is operated by an electrical motor, this motor being actuated in response to a switch. The vent member is coupled to an exhaust duct having a blower at its exhaust end so it provides suction in the vent which draws in the fumes to be exhausted.

It is therefore an object of this invention to provide an improved exhaust system for a cooktop having a motor-driven vent intake element which can be raised above the level of the cooktop to a venting position and retracted within the cooktop when not in use.

It is a further object of this invention to provide an improved venting system for a cooktop which provides efficient venting of fumes which does not develop a cooling airstream for food being cooked.

Other objects of this invention will become apparent as the description proceeds in connection with the accompanying drawings of which:

Figure 6:
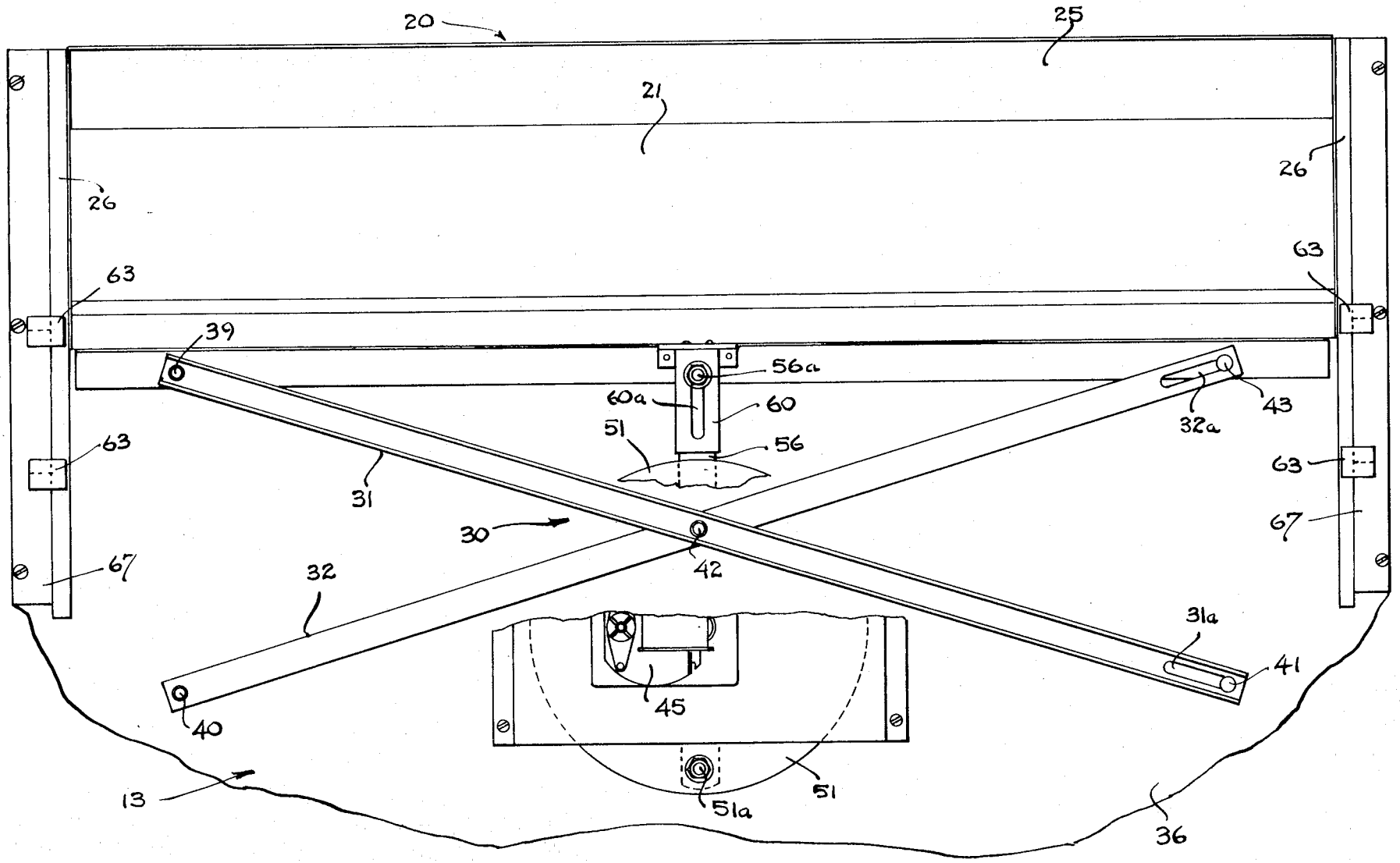
FIG. 6 is a front elevational view of the preferred embodiment.

Referring now to FIGS. 1–6, a preferred embodiment of the invention is illustrated. Cooktop 11 has a plurality of heating units 12 installed therein with appropriate controls 14 for each of the units. Mounted along the rear edge of the cooktop for the entire longitudinal extent of the heating units 12 is a vent member 13 which includes a fixed elongated relatively narrow air chamber 15 and a rasiable intake or "snorkel" member 20 which is mounted in the chamber. Snorkel 20, which may be formed from a pair of panels 21 and 22 joined together along their edges in airtight sealed relationship by means of strips 26, is slidably supported in chamber 15. A venting intake slot 25 is formed between the top edge of the front panel 21 and the bottom surface of strip member 27 which runs between the top edges of strips 26. As shown in FIG. 6, scissors-type support member 30 is formed from a pair of arms 31 and 32, one of the ends of each of the arms being attached to the snorkel member 20 near the opposite ends thereof, the other of the ends of each of these arms being attached to the rear wall 36 of the vent member. Arm 31 has a slot 31*a* near the bottom end thereof, this slotted portion being slidably fitted on shoulder rivet 41 which is fixedly attached to wall 36. Arm 32 has a slot 32*a* near the top end thereof which is slidably fitted over shoulder rivet 43 which is fixedly attached to the bottom of the snorkel member. The arms 31 and 32 are pivotally connected together at their centers by means of pivot pin 42. The top end of arm 31 is pivotally attached to the bottom of the snorkel by means of shoulder rivet 39 while the bottom end of arm 32 is pivotally supported on wall 36 by means of shoulder rivet 40.

Electrical motor 45, which is a low-speed high-torque geared motor, is fixedly supported on wall 36 of the vent member and has its driven shaft directly coupled to the center of crank wheel 51. Crank arm 56 is pivotally connected to the bottom of crank wheel 51 by means of pivot pin 51*a*. Crank arm 56 has a pin 56*a* near the top end thereof. Pin 56*a* is slidably fitted and retained by means of washer 53 and nut 54 in slot 60*a* formed in bracket 60 which is attached to the bottom of snorkel member 20. The side strips 26 of the snorkel member slidably ride in guide members 63 which are fixedly mounted on the side walls 67 of air chamber 15.

Figure 3:
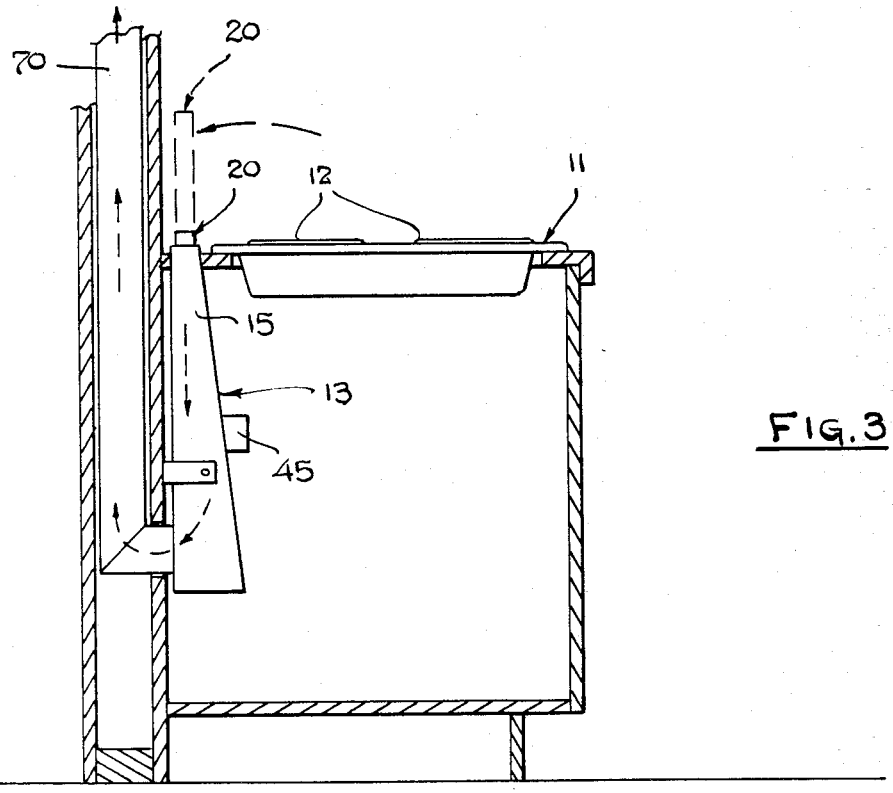
FIG. 3 is a side cross-sectional exploded view of the preferred embodiment.
Figure 4:
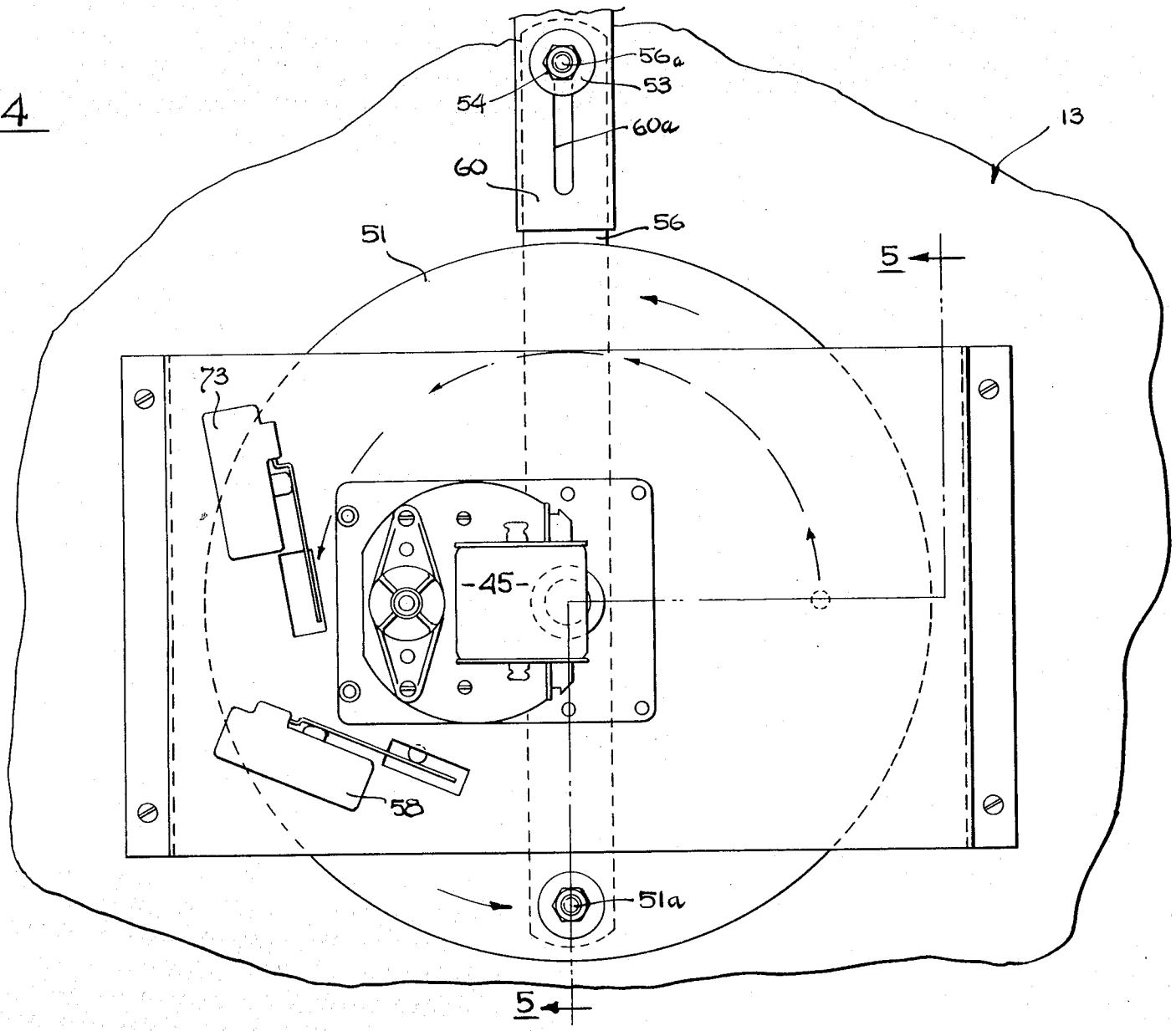
FIG. 4 is a plan view illustrating the drive mechanism of the preferred embodiment.
Figure 5:
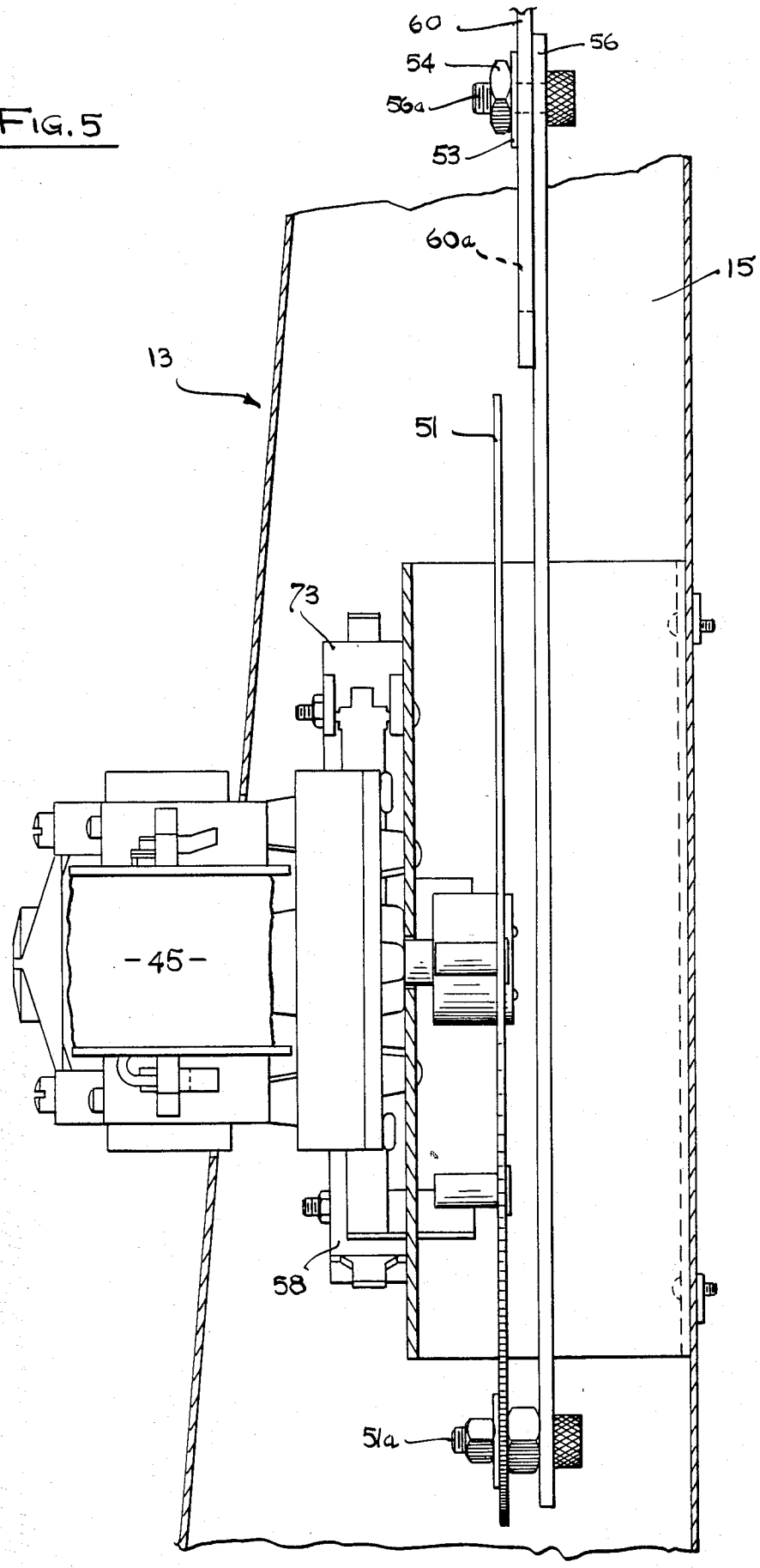
FIG. 5 is a side elevational view of the drive mechanism of the preferred embodiment.

As can best be seen in FIG. 3, a venting duct 70 is connected to chamber 15 and is used to draw air from the chamber. Duct 70 may be outletted through the roof 72. An exhaust blower 75 is provided at the duct outlet to draw a partial vacuum therein for creating a suction in the duct and air chamber so as to induce an air flow into the chamber through intake 25 and out through the duct.

Figure 1:
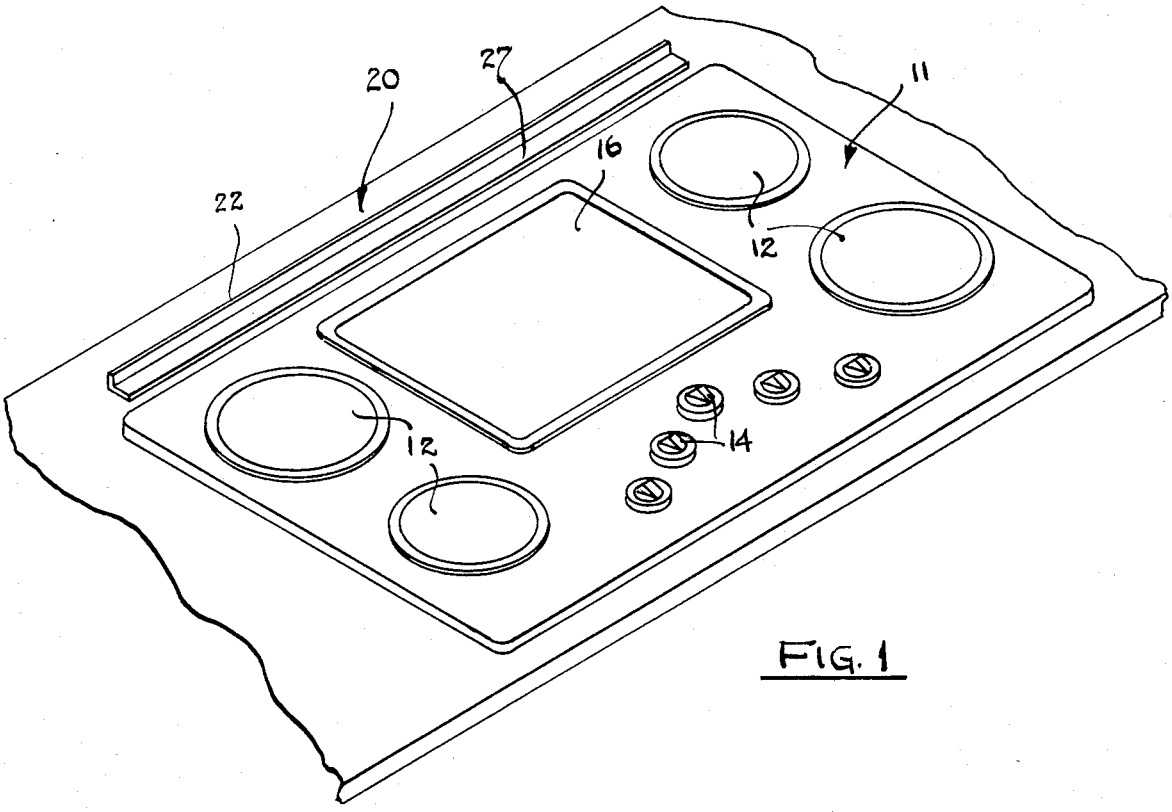
FIG. 1 is a perspective view of a preferred embodiment of the invention.
Figure 2:
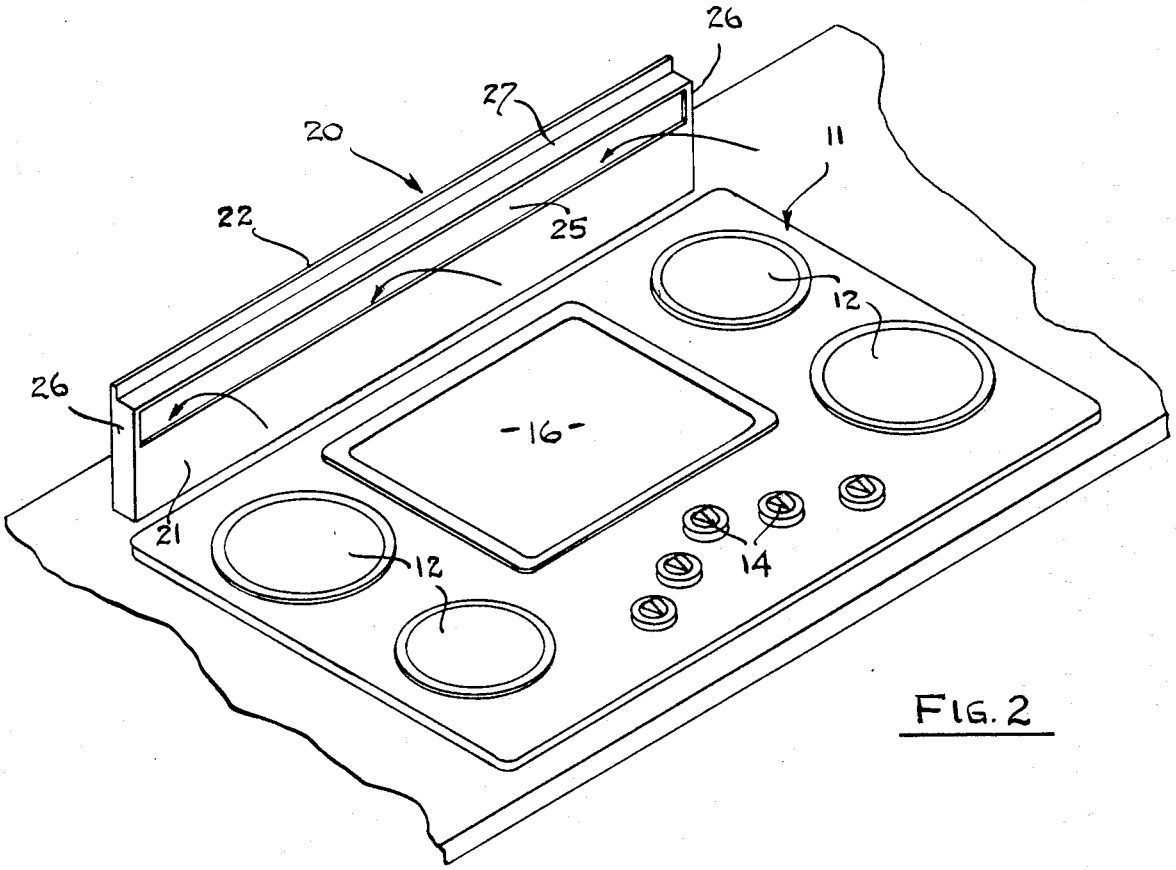
FIG. 2 is a perspective view of the preferred embodiment showing the vent in the raised position.
Figure 7:
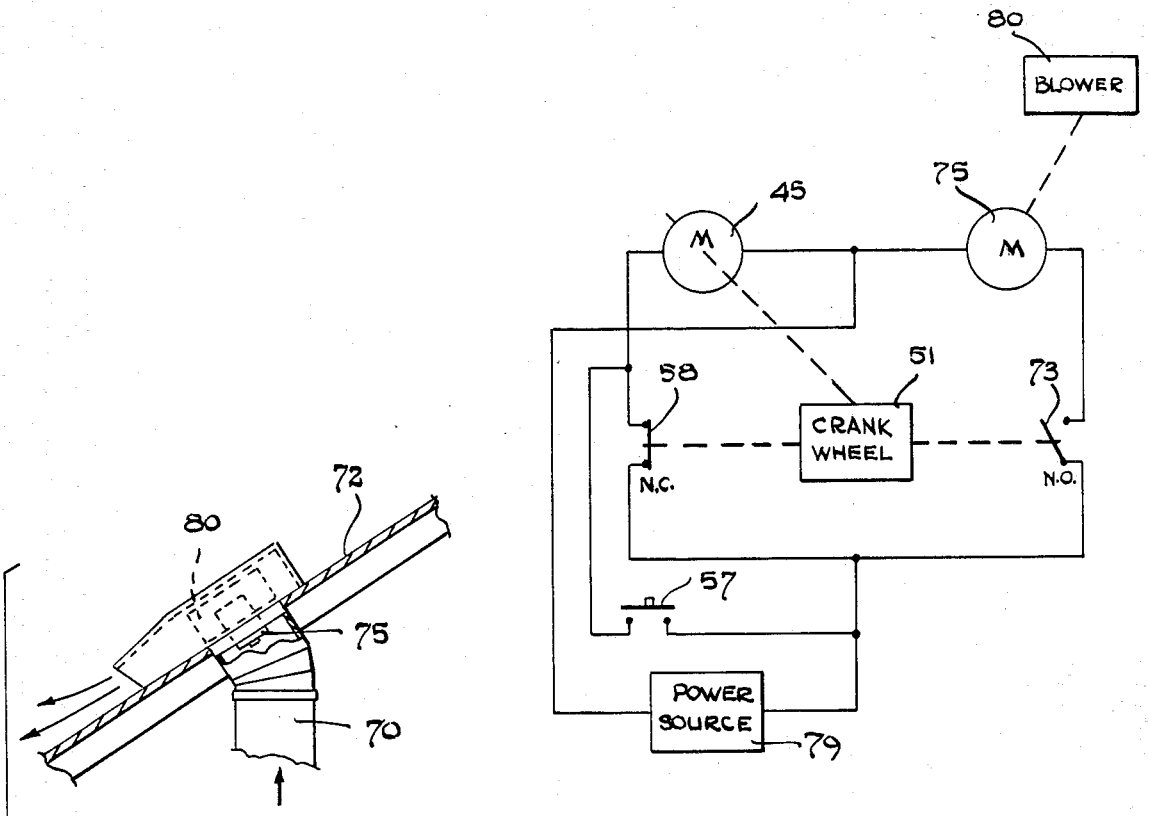
FIG. 7 is a schematic view of the electrical circuitry of the preferred embodiment.

Referring now to FIG. 7, electrical circuitry for operating the vent member is schematically illustrated. The drawing shows the device in its initial "at rest" position. A momentary pushbutton switch 57 is used to start the geared motor 45 when the snorkel is to be raised or lowered. With the device in the "at rest" position, a cam on crank wheel 51 is in a position so as to actuate normally closed switch 58 to its open position. When the pushbutton switch 57 is momentarily activated, it causes motor 45 to turn crank wheel 51 sufficiently to unseat the aforementioned cam from switch 58, thereby permitting this switch to close and provide continual power to motor 45. The crank wheel 51 thus is rotatably driven and in turn drives crank arm 56 so as to drive against bracket 60 and raise the snorkel. When the snorkel reaches its raised position, another cam on the crank wheel actuates switch 58 to open this switch, thereby deactivating motor 45. Switch 57 may be located on the cooktop or may be remotely located and connected to the cooktop by an "umbilical" wire. At the same time, a third cam on the crank wheel closes normally open switch 73 to provide power to the blower motor 75 so as to start the duct blower 80. A second actuation of switch 57 results in the deactuation of normally closed switch 58 causing motor 45 to drive crank wheel 51 and along with it crank arm 56 so as to lower the snorkel. At the same time, the cam which had been actuating switch 73 releases this switch so as to deactivate blower motor 75. When the snorkel reaches the "down" position, the first-mentioned cam actuates switch 58 to drive it to the "open" position, thereby deactivating motor 45.

It is to be noted that tight sealing is provided along the edges between the vent member and the slot in which it is installed when the vent member is in its raised position so that there is little or no leakage at this point and the full suction provided by the duct appears along the vent intake. Also, when the vent member is in its lowered position, it closes off the vent intake opening, thus avoiding backdrafts from the outside. Thus, highly efficient venting is afforded in a device which is automatically raised and lowered in response to pushbutton control.

While the invention has been described and illustrated in detail, it is to be clearly understood that this is intended by way of illustration and example only and is not to be taken by way of limitation, the spirit and scope of this invention being limited only by the terms of the following claims.

I claim:

1. In a cooktop having heating unit means, a venting system for venting fumes comprising:

a vent member having an air chamber and a snorkel member slidably mounted in said chamber, said snorkel member being formed from a pair of opposing sheets and side strips joining said sheets together along the edges thereof, a surface of one of said sheets facing towards said heating unit means and a venting intake slot providing fluid communication to said chamber being formed along the top edge of said last-mentioned sheet, said intake slot being the only venting intake of said vent member, and venting exhaust means including a venting duct having an intake end connected to said chamber and an exhaust end and blower means mounted at said exhaust end of the duct for providing suction in said duct and said chamber, a control switch, and motor drive means responsive to actuation of said control switch for driving said snorkel member from a retracted position in the chamber to an extended position substantially normal to the surface of the cooktop with the venting intake slot at a level substantially above that of the heating unit means and responsive to a second actuation of said control switch for driving said snorkel member back to its retracted position within the chamber, said motor drive means including a scissors mechanism, said snorkel member being mounted in said chamber on said scissors mechanism, said mechanism having a pair of arms which are pivotally connected at their centers, one of the ends of each of said arms being supported on a wall of said chamber, the other of the ends of each of said arms being attached to said snorkel member.

2. The venting system of claim 1 wherein said motor means comprises an electric motor, a crank wheel rotatably driven by said motor and a crank arm pivotally connected to said crank arm, said crank arm being connected to said snorkel member.

3. The system of claim 1 wherein the side walls of said chamber have guide members fixedly mounted thereon, said snorkel having side strips which ride in said guide members.

4. The system of claim 1 wherein said heating unit means comprises a plurality of heating units.

5. In a cooktop having heating unit means, a venting system for venting fumes comprising:

a vent member having an air chamber and a snorkel member slidably mounted in said chamber, said snorkel member being formed from a pair of opposing sheets and side strips joining said sheets together along the edges thereof, a surface of one of said sheets facing towards said heating unit means and a venting intake slot providing fluid communication to said chamber being formed along the top edge of said last-mentioned sheet, said intake slot being the only venting intake of said vent member, and venting exhaust means including a venting duct having an intake end connected to said chamber and an exhaust end and blower means mounted at said exhaust end of the duct for providing suction in said duct and said chamber, a control switch, and motor drive means responsive to actuation of said control switch for driving said snorkel member from a retracted position in the chamber to an extended position substantially normal to the surface of the cooktop with the venting intake slot at a level substantially above that of the heating unit means and responsive to a second actuation of said control switch for driving said snorkel member back to its retracted position within the chamber, said motor drive means comprising an electric motor, a crank wheel rotatably driven by said motor and a crank arm pivotally connected to said crank arm, said crank arm being connected to said snorkel member.

* * * * *